United States Patent [19]

Commins

[11] Patent Number: 4,714,372

[45] Date of Patent: Dec. 22, 1987

[54] HURRICANE TIE

[75] Inventor: Alfred D. Commins, Danville, Calif.

[73] Assignee: Simpson Strong-Tie Company, Inc., San Leandro, Calif.

[21] Appl. No.: 897,702

[22] Filed: Aug. 18, 1986

[51] Int. Cl.[4] ..... B25G 3/36

[52] U.S. Cl. ..... 403/400; 403/346; 403/405.1; 52/92

[58] Field of Search ..... 403/400, 405.1, 232.1, 403/346; 52/92

[56] References Cited

U.S. PATENT DOCUMENTS

| | | | |
|---|---|---|---|
| D. 248,274 | 6/1978 | Kingston | D8/354 |
| 2,321,221 | 6/1943 | Linehas . | |
| 2,413,362 | 12/1946 | Maxwell . | |
| 3,091,822 | 6/1963 | Fiekers . | |
| 3,184,800 | 5/1965 | Nelson . | |
| 3,256,030 | 6/1966 | Banse . | |
| 3,423,898 | 1/1969 | Tracy | 52/713 |
| 3,596,941 | 8/1971 | Tracy . | |
| 4,410,294 | 10/1983 | Gilb | 403/27 |
| 4,536,101 | 8/1985 | Jones | 403/232.1 X |
| 4,572,695 | 2/1986 | Gilb | 403/232.1 |

FOREIGN PATENT DOCUMENTS

| | | | |
|---|---|---|---|
| 6627 | 3/1927 | Australia | 403/400 |

OTHER PUBLICATIONS

Modern Carpentry Catalog, 1973, p. 164.
Simspon Strong-Tie Catalog, 1985, p. 28.
Silver Catalog, 1981, p. 21.
KC Metals Catalog, 1983, p. 26.

*Primary Examiner*—Andrew V. Kundrat
*Attorney, Agent, or Firm*—James R. Cypher

[57] ABSTRACT

A hurricane tie for connecting wood members in a building structure having a unitary sheet metal body member including a truncated generally right angled triangular base member and a generally right angled triangular web member arranged in reverse apex order with respect to one another. The base and web members lie in planes which are mutually angularly related to one another. The base and web members are formed with fastener openings for connecting the tie to the wood members.

3 Claims, 10 Drawing Figures

HURRICANE TIE

BACKGROUND OF THE INVENTION

This invention relates to sheet metal tie members for connecting wood members in building structures. In addition to its use as a nearly universal tie member, it relates to sheet metal tie members for joining wood bottom chords of trusses to wood top plate members.

Early patents on metal joist hanger connectors date back to the late 1900's and were well developed by the early 1960's. Universal joint connectors, however, were very slow in developing due to the reluctance of building industry craftsmen to give up the time honored "toe-nailing" practice.

In the Eastern United States, a few jointing connectors such as those disclosed in Linehan, U.S. Pat. No. 2,321,221, 1943; and Maxwell U.S. Pat. No. 2,413,362, 1946; quickly gave way to simplified ties such as the one illustrated in FIG. 8. Note that the tie shown in FIG. 8 is almost a duplicate of Maxwell, supra, with the surplus wing element omitted.

In the Western United States, there is no evidence that either the Linehan or Maxwell's connector was ever used. Universal framing anchors were available in the early 1960's, but a tie such as the one illustrated in FIG. 9 was not offered on the West Coast until the early 1970's.

In 1984, Gilb obtained U.S. Pat. No. 4,572,695 for a wood jointing connector, and this connector has received enthusiastic acceptance in the do-it-yourself market.

It is still a fact that sheet metal jointing connectors simply are not commercially accepted unless they are demonstrably superior to toe-nailing and cheaper, stronger, and easier to install than previous sheet metal connectors.

SUMMARY OF THE INVENTION

The gist of the present invention is the construction of a sheet metal tie connector for wood frame construction which incorporates in a uniquely configured "two-plane" tension connector a maximum width in the critical portion to give dramatically increased tension strength; a radius curved cutout to minimize "notch effect" failure in the critical portion; and maximum angular rigidity between the two planes.

The main objective of the present invention is to provide maximum tension tie strength with a minimum amount of metal in a simple "twin-plane" sheet metal connector.

Another objective is to construct a connector that can be used in a number of different wood joint configurations.

A further objective is to provide a connector which can be economically manufactured on continuous die machinery.

Still another objective is to provide a connector which can be easily and quickly installed by skilled or non-skilled persons.

A further objective is to provide a sheet metal connector which can be used to connect wood bottom chord trusses to top plates on the inside wall without requiring notching of the wall board, and used on the outside wall without requiring notching of the sheathing board.

DESCRIPTION OF THE PREFERRED EMBODIMENTS

Figure 1:
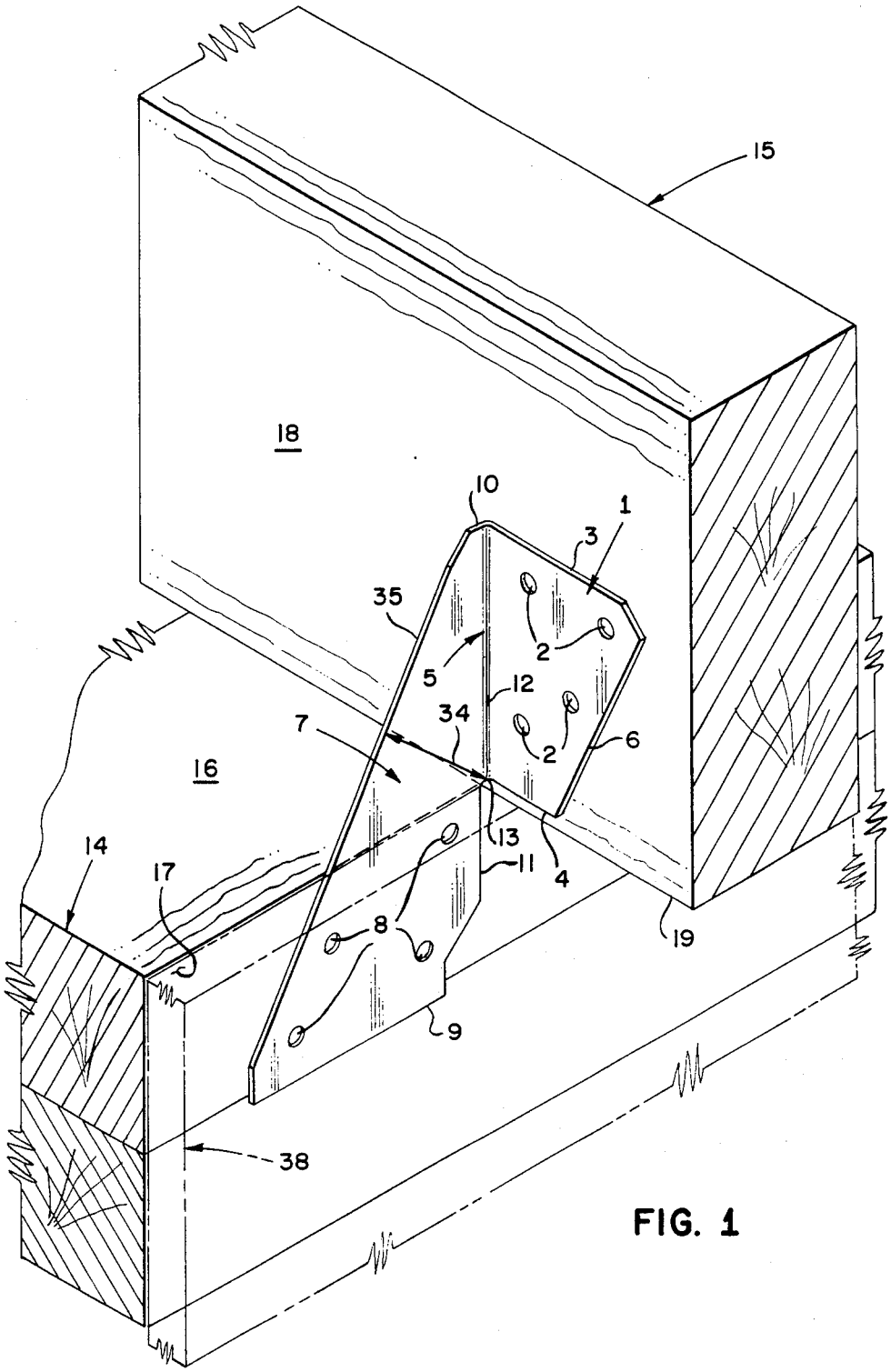
FIG. 1 is a perspective view of one form of the invention shown in one of many typical jointing arrangements. A portion of a bottom wood truss chord is illustrated resting on a top plate of a wood framed wall member. A portion of a wall board member is shown in phantom line to show the arrangement of the wall board with respect to the wood members and the connector.

The sheet metal tie of the present invention for connecting wood members in a building structure consists briefly of a truncated generally right angled triangular base member 1 having an area dimensioned for and pierced by a plurality of nail holes 2. The base member includes a generally straight base edge 3, a generally straight truncated edge 4 joined by an inside edge 5. The hypotenuse edge is indicated by the number 6.

The tie member also includes a truncated generally right angled triangular web member 7 which has an area dimensioned for and pierced by a plurality of nail holes 8. The web member includes a generally straight base edge 9 and a truncated edge 10 which is joined by an inside edge 11. The base member and the web member are joined together along the respective inside edges 5 and 11.

The triangular web member 7 has a relatively larger area than the triangular base member 1 and the generally triangular members are arranged in reverse apex order with respect to one another.

Figures 7, 8, 9:
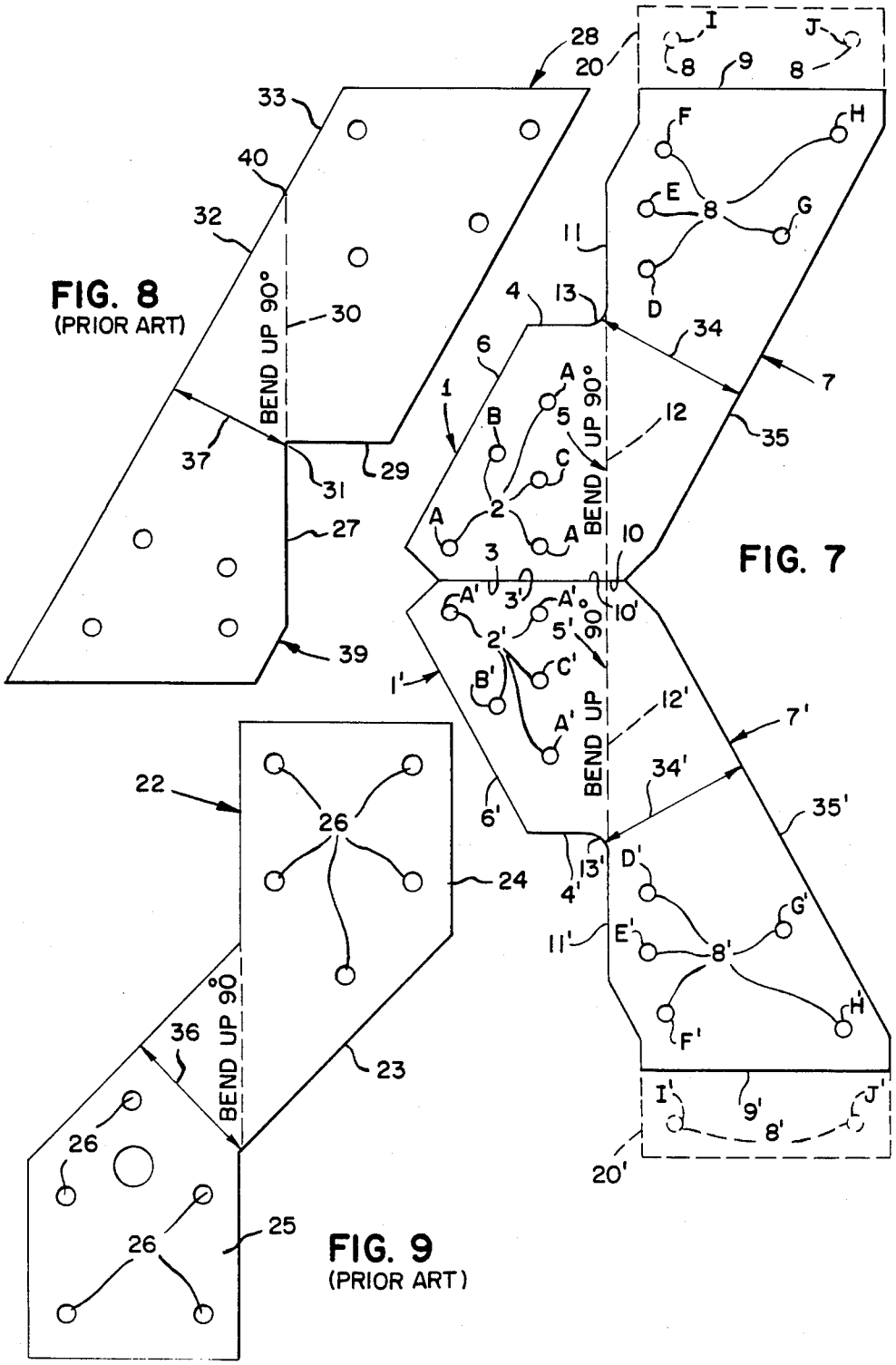
FIG. 8 (PRIOR ART)
FIG. 9 (PRIOR ART)
FIG. 7 is a plan view of a pair of right and left sheet metal connectors of the present invention in blank form prior to separation and bending.
FIG. 8 is a Prior Art sheet metal tie in blank form prior to bending illustrating a form of tie presently being sold and used on the East Coast of the United States.
FIG. 9 is a Prior Art sheet metal tie in blank form prior to bending illustrating a form of tie presently being sold and used on the West Coast of the United States.

Referring to FIG. 7, the blank member is bent along line 12 after the cuts are made to form inside edge 5. The bend made along bend line 12 may be any angle desired. In most instances, however, the bend will be a right angle and the base and web members will lie in planes which are mutually perpendicular to each other.

A feature of the present invention is the formation of a radiused curve 13 at the juncture of inside edge 11 of web member 7 and the truncated edge 4 of the base member 1. The radiused curve decreases the likelihood of tearing of the tie under large loads. This premature tearing is sometimes referred to as the "notch effect".

The truncated edge 10 of the web member 7 is generally in alignment with a portion of base edge 3 of the base member 1 adjacent the inside edge 5 of the base member 1. This construction maximizes the angular rigidty of the tie member for the least amount of metal.

The hurricane tie of the present invention as shown in FIG. 7 is made in so-called left and right forms. The left and right forms are identical in shape except that the base members are folded in opposite directions in relation to the web members. Since the ties are identical, like numbers have been assigned to like parts except for the addition of the prime symbol (').

Figure 5:
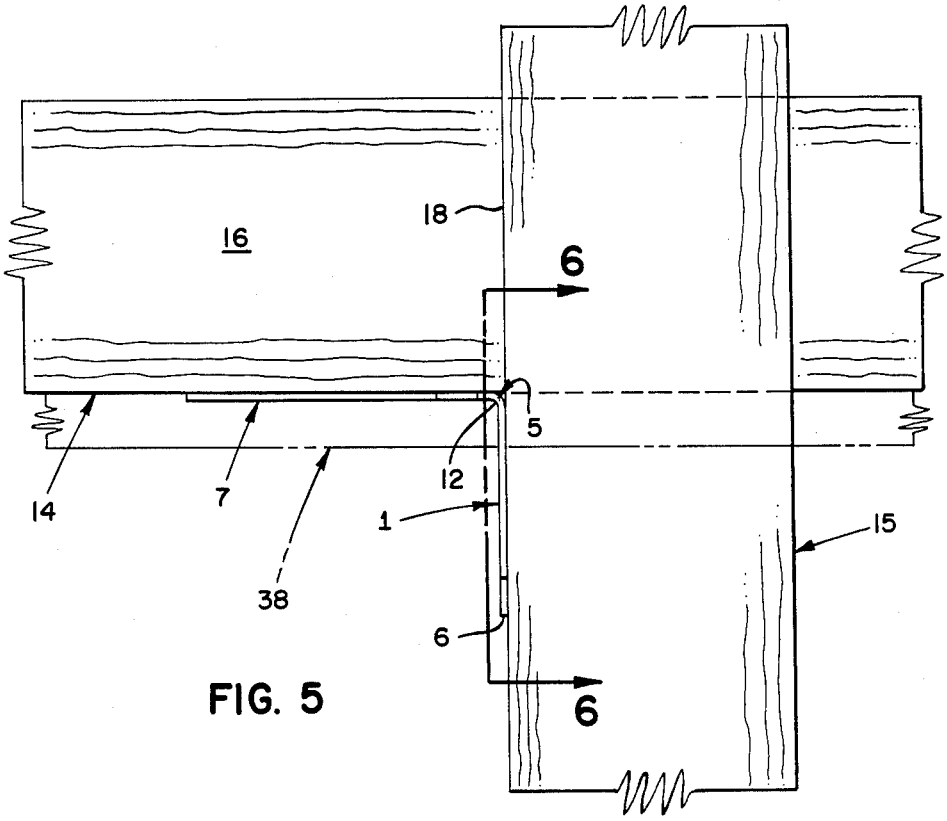
FIG. 5 is a top plan view of the connector shown in FIG. 1.
Figure 6:
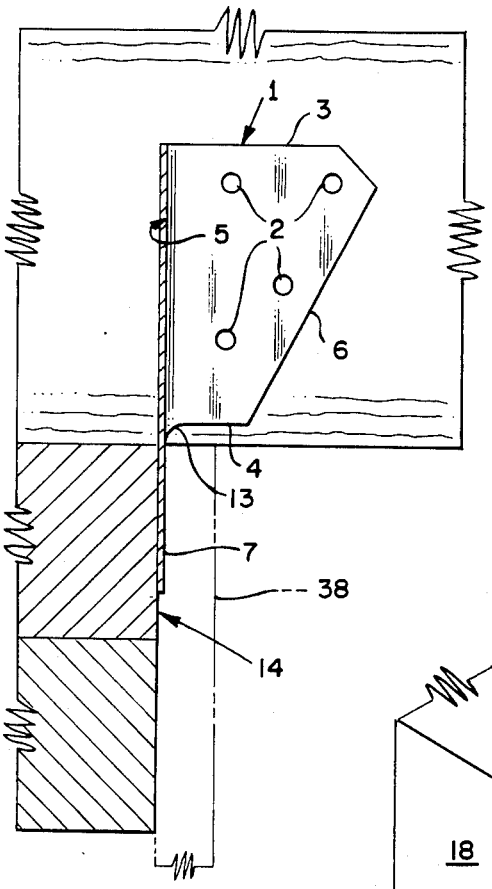
FIG. 6 is a side view taken along line 6—6 of FIG. 5 with a portion of the connector in cross section.

Referring to FIGS. 1 and 5, the hurricane tie of the present invention is shown in one of its preferred uses. A portion of a wood plate member 14 is shown which represents the top plate for a wood stud wall. Directly on top of plate member 14 is a wood base member 15 which illustrates a portion of a bottom chord of a truss member. The plate member 14 has a generally planar top face 16 and a right angular edge face 17. The wood base member 15 has a generally planar side face 18 and a generally planar edge face 19 in registration with the top face 16 of the wood plate member 14.

Installation and operation of the hurricane tie may be illustrated by again referring to FIGS. 1 and 5. After the bottom chord 15 of the truss is placed on the top plate 14, the base member 1 of the hurricane tie is placed against planar side face 18 of the wood base member 15 so that web member 7 is in contact with edge face 17 of the top plate 14. The hurricane tie is then moved up or down so that truncated edge 4 of the base member 1 is at or slightly above the top of surface 16 of the plate member 14. This positioning places the radiused curve portion 13 at or above the surface 16 of plate member 14. Nails are then driven through holes 2 in the base member into wood base member 15. Next, nails are driven through holes 8 of the web member 7 into plate member 14 and the installation is completed. Where code requirements require it, another hurricane tie is connected to the opposite side of the base member 15 and to plate member 14 as previously described.

In FIGS. 1 and 5, the illustrations show the hurricane tie affixed to the inside of a wall. The phantom lines illustrate a portion of gypsum wall board 38 attached to the top plate member 14. As illustrated in the drawings, no part of the hurricane tie interferes with the installation of the gypsum board. It is not necessary to notch out the gypsum board to make room for the hurricane tie.

An advantage of the present hurricane tie is the fact that it may also be attached to the outside of the wall and to the base member 15 of the truss. When attached to the outside wall, the sheathing need not be notched as the hurricane tie can be installed to provide clearance for the sheathing. This installation is not illustrated as it is deemed obvious.

Figure 2:
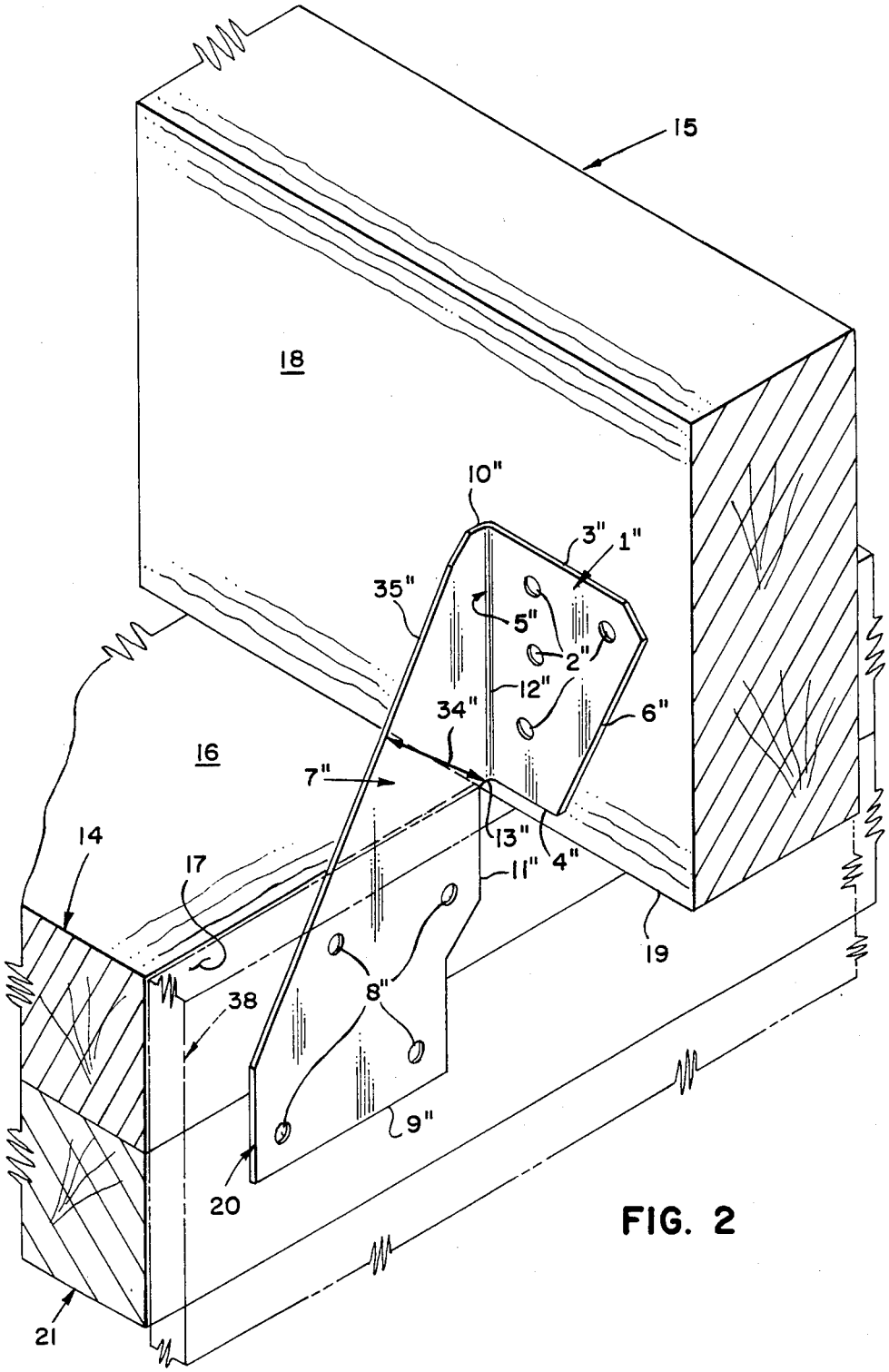
FIG. 2 is a perspective view of another form of the invention shown in FIG. 1. The connector shown is particularly suitable for connection to double top plate construction. A portion of the wood bottom chord is illustrated resting on the top chords. A portion of a wall board member is illustrated in phantom line.
Figure 3:
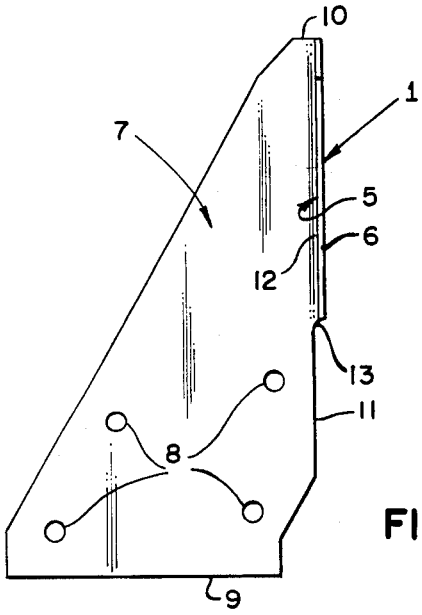
FIG. 3 is a side view of the connector shown in FIG. 1.
Figure 4:
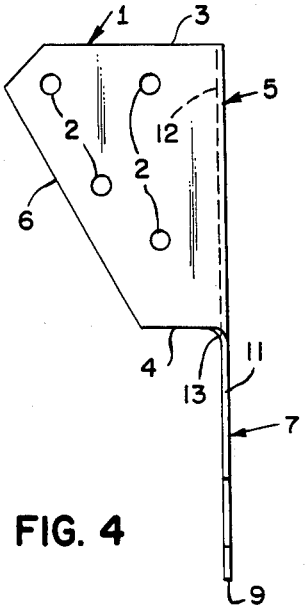
FIG. 4 is a front view of the connector shown in FIG. 3.

Another form of the invention is shown in FIGS. 2 and 7. The hurricane tie as shown in these two drawings is identical to the form shown in FIG. 1 except that the web member is elongated by an extension indicated by the number 20. Since the two hurricane ties are identical in every other respect except for the nail hole pattern, the description is not repeated. Like parts have been designated by the same number but with the addition of a double prime symbol ("). The bottom plate is designated by the number 21.

Referring to FIG. 7, if one desires to construct the form of tie illustrated in FIG. 1, holes designated by the letters, A,B,D,F,G, and H should be punched in the blank. On the other hand, to make the tie shown in FIG. 2, holes designated by the letters A,C,E,G,I, and J should be punched in the blank.

The hurricane tie shown in FIG. 2 may be constructed in the same manner as the hurricane tie as shown in FIG. 1 except that a wider coil of metal is used. Thus as shown in FIG. 7, the hurricane tie is made by cutting the blank as shown in dotted lines. This arrangement makes it very inexpensive to make either form of the invention.

Figure 10:
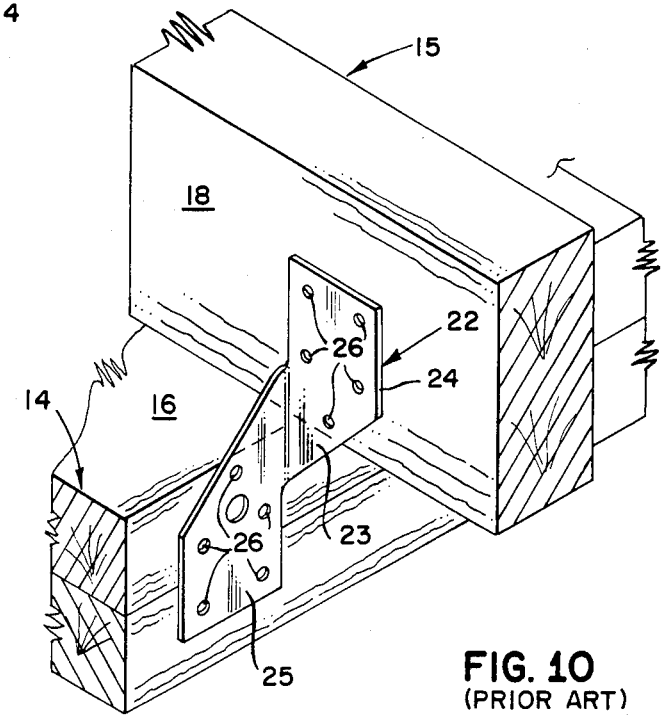
FIG. 10 (PRIOR ART)

Construction of the hurricane tie illustrated in FIG. 2 which is designated and sold by Simpson Strong-Tie Company, Inc. as an "H5" results in a hurricane tie which increases performance a full 31% over the comparable prior art hurricane tie which is illustrated in FIGS. 9 and 10 and sold by Simpson Strong-Tie Co. as an "H2.5". A maximum allowable uplift load of 485 pounds is possible whereas the Simpson "H2.5" hurricane tie of FIGS. 9 and 10 provides a maximum uplift load of only 370 pounds. Still another advantage is the fact that the present hurricane tie requires only 8 nails for installation whereas the Simpson "H2.5" prior art tie of FIG. 10 requires 10 nails for installation.

The main disadvantage of the prior art hurricane tie 22 shown in FIG. 10 is the fact that extension portion 23 of base member 24 extends into the clear opening between the intersection of top plate member 14 and wood base member 15 which may be the bottom chord of a truss member. Thus, if it were desired to sheet rock the inside wall, a notch would have to be made in the gypsum board around extension 23 of the hanger tie member 24. Also, if the prior art tie was installed on the outside of the wall, and sheathing boards were placed up against the bottom chord 15 of a truss, the sheathing board would have to be notched in the vicinity of the extension portion 23 of the hurricane tie 24. The web member is indicated by number 25 and nail holes by number 26.

Another prior art hurricane tie is illustrated in FIG. 8. This hurricane tie is used in the Eastern United States. This tie member uses a greater amount of metal than the tie of the present invention and has less uplift strength than the present invention. The tie of FIG. 8 consists of a web member 39, having an inside edge 27, a base member 28 having a truncated edge 29 and bent along bend line 30.

The main differences between prior art tie of FIG. 8 and the present invention are as follows. The present invention is formed with a radiused curve 13 at the intersection of truncated edge 4 and inside edge 11 as shown in FIG. 7 whereas the intersection of lines 26 and 29 is a right angled notch 31 as shown in FIG. 8. This results in the tie of FIG. 8 being subject to premature tearing beginning at intersection point or notch 31. This is also known as a "notching effect" failure.

Another difference is the fact that when the tie of FIG. 8 is bent at bend line 30, the intersections of web edge 32 and base edge 33 intersect in a point 40. This results in a loss of angle stiffness as compared with the tie of the present invention.

A major advantage of the present invention over all of the prior art ties is the fact that the tie of the present invention has a greater width section of material at the narrowest unsecured width portion which is also known as the "critical width". Referring to FIGS. 1 and 7, this "critical width" is indicated by the double arrow 34. This "critical width" is the width of the material in the web member 7 as measured at a right angle from a point on web edge 35 to the radiused curve 13. As a specific example, the tie shown in FIGS. 1 and 7 is designated and sold by Simpson Strong-Tie Company, Inc as an "H4". This "H4" tie has a critical width of 1 3/16", a weight of 1.3 oz. and is rated at a maximum allowable uplift load of 360 pounds.

The comparable "critical width" on the prior art tie shown in FIG. 9 is shown by double headed arrow 36. This tie is designated and sold by Simpson Strong-Tie Company, Inc. as an "H3". This "H3" tie has a critical width of 1 1/16", a weight of 1.4 oz. and is rated at a maximum allowable uplift load of 305 pounds.

Thus in comparring the tie of the present invention which is known as a Simpson "H4" with the prior art tie shown in FIG. 9 which is known as a Simpson "H3", the present invention "H4" tie has a critical width which is 11.76% greater, yet has a weight 7.7% less and an 18% increase in maximum allowable uplift load capacity.

The maximum allowable uplift load capacity of the prior art device shown in FIG. 8 which is sold on the East Coast by Basch Products, Inc., by test results is 341 pounds. This is 5.6% less than the comparable tie of the present invention yet the tie of this invention weighs 17% less than the Basch product. The comparable "critical width" on the prior art tie shown in FIG. 8 as shown by double headed arrow 37 is 1 1/16".

As an example, the present invention as illustrated in FIG. 1 may be constructed from 20 gauge sheet metal. Preferably the metal is galvanized. Overall length is 3⅝" with a web width of 2⅛" and a base width of 1½". The distance from the web base to the truncated edge may be 1¾".

The form of the invention illustrated in FIG. 2 is also 20 gauge steel but has an overall length of 4¼".

I claim:

1. A sheet metal tie for connecting wood members in building structures comprising:

a. a unitary body member including a truncated, generally right angled triangular, base member having an area dimensioned for and pierced by a plurality of nail holes and including a generally straight base edge and a generally straight truncated edge joined by an inside edge;

b. a truncated generally right angled triangular web member having an area dimensioned for and pierced by a plurality of nail holes and including a generally straight base edge and a truncated edge joined by an inside edge and joined to said base member along said respective inside edges;

c. said triangular web member having a relatively larger area than said triangular base member and said generally triangular members being arranged in reverse apex order with respect to one another;

d. said base and web members lie in planes which are mutually angularly related to each other;

e. the juncture of said inside edge of said web member and said truncated edge of said base member is formed with a radiused curve; and f. said truncated edge of said web member is generally in alignment with a portion of said base edge of said base member adjacent said inside edge of said base member.

2. A sheet metal tie as described in claim 1 wherein:

a. said base and web members lie in planes which are mutually perpendicular to each other.

3. In a wood frame structure including a wood plate member having a generally planar top face and a right angular edge face crossed by a wood base member having a generally planar side face and a generally planar edge face in registration with said top face of said wood plate member, a sheet metal connector comprising:

a. a unitary body member including a truncated, generally right angled triangular, base member having an area dimensioned for and pierced by a plurality of nail holes and including a generally straight base edge and a generally straight truncated edge joined by an inside edge;

b. a truncated generally right angled triangular web member having an area dimensioned for and pierced by a plurality of nail holes and including a generally straight base edge and a truncated edge joined by an inside edge and joined to said base member along said respective inside edges;

c. said triangular web member having a relatively larger area than said triangular base member and said generally triangular members being arranged in reverse apex order with respect to one another;

d. said base and web members lying in planes which are mutually perpendicular to each other;

e. the juncture of said inside edge of said web member and said truncated edge of said base member is formed with a radiused curve;

f. said truncated edge of said web member is generally in alignment with said base edge of said base member;

g. said web member is connected to said edge face of said plate member;

h. said base member is connected to said side face of said wood base member; and i. said juncture of said inside edge of said web member and said truncated edge of said base member is located generally at or above said top face of said plate member.

* * * * *